US008561599B2

(12) United States Patent
Gingrich et al.

(10) Patent No.: US 8,561,599 B2
(45) Date of Patent: Oct. 22, 2013

(54) EGR DISTRIBUTOR APPARATUS FOR DEDICATED EGR CONFIGURATION

(75) Inventors: Jess W. Gingrich, San Antonio, TX (US); Steven H. Almaraz, Seguin, TX (US)

(73) Assignee: Southwest Research Institute, San Antonio, TX (US)

( * ) Notice: Subject to any disclaimer, the term of this patent is extended or adjusted under 35 U.S.C. 154(b) by 306 days.

(21) Appl. No.: 13/025,912

(22) Filed: Feb. 11, 2011

(65) Prior Publication Data

US 2012/0204845 A1 Aug. 16, 2012

(51) Int. Cl.
*F02M 25/07* (2006.01)

(52) U.S. Cl.
USPC ..... 123/568.17

(58) Field of Classification Search
USPC ..... 123/568.17
See application file for complete search history.

(56) References Cited

U.S. PATENT DOCUMENTS

| | | | | |
|---|---|---|---|---|
| 3,156,162 | A | 11/1964 | Wallace et al. | |
| 3,303,831 | A | 2/1967 | Sherman | |
| 3,405,679 | A | 10/1968 | Norris et al. | |
| 3,405,697 | A | 10/1968 | Marchand | |
| 3,680,534 | A * | 8/1972 | Chavant | 123/568.17 |
| 3,805,752 | A | 4/1974 | Cataldo | |
| 3,924,576 | A | 12/1975 | Siewert | |
| 3,941,113 | A | 3/1976 | Bauelin | |
| 4,108,114 | A | 8/1978 | Kosaka et al. | |
| 4,131,095 | A | 12/1978 | Ouchi | |
| 4,179,892 | A | 12/1979 | Heydrich | |
| 5,178,119 | A | 1/1993 | Gale | |
| 5,207,714 | A * | 5/1993 | Hayashi et al. | 123/568.17 |
| 5,257,600 | A | 11/1993 | Schechter et al. | |
| 5,456,240 | A | 10/1995 | Kanesaka | |
| 5,517,976 | A | 5/1996 | Bachle et al. | |
| 5,894,726 | A | 4/1999 | Monnier | |
| 6,009,709 | A | 1/2000 | Bailey | |
| 6,138,650 | A | 10/2000 | Bailey | |
| 6,216,458 | B1 | 4/2001 | Alger et al. | |
| 6,286,489 | B1 | 9/2001 | Bailey | |
| 6,343,594 | B1 * | 2/2002 | Koeslin et al. | 123/568.17 |
| 6,425,381 | B1 | 7/2002 | Rammer | |
| 6,484,702 | B1 | 11/2002 | Riley | |
| 6,536,392 | B2 | 3/2003 | Widener | |

(Continued)

FOREIGN PATENT DOCUMENTS

| | | |
|---|---|---|
| GB | 2110791 | 11/1982 |
| JP | 11247665 | 9/1999 |

OTHER PUBLICATIONS

International Search Report and Written Opinion dated Oct. 2, 2006 issued in International Patent Application No. PCT/US0540483.

(Continued)

*Primary Examiner* — Hai Huynh
(74) *Attorney, Agent, or Firm* — Grossman, Tucker et al

(57) ABSTRACT

The present disclosure relates to methods, apparatuses and systems to manage exhaust gas expelled from an internal combustion engine. More particularly, the present disclosure provides an exhaust gas recirculation apparatus to distribute recirculated exhaust gas in an air stream to be introduced to an internal combustion engine, with the apparatus comprising an intake passage defined by a wall structure, the wall structure including a plurality of apertures therein configured to distribute recirculated exhaust gas into the intake passage.

25 Claims, 7 Drawing Sheets

(56) References Cited

U.S. PATENT DOCUMENTS

| | | | | |
|---|---|---|---|---|
| 6,609,374 | B2 * | 8/2003 | Feucht et al. | 60/602 |
| 6,655,324 | B2 | 12/2003 | Cohn et al. | |
| 6,672,292 | B2 * | 1/2004 | Fischer | 123/568.17 |
| 6,742,507 | B2 | 6/2004 | Keefer et al. | |
| 6,789,531 | B1 | 9/2004 | Remmels | |
| 6,820,415 | B2 | 11/2004 | Abet et al. | |
| 6,871,642 | B1 | 3/2005 | Osterwald | |
| 6,877,492 | B1 | 4/2005 | Osterwald | |
| 6,918,251 | B2 | 7/2005 | Yanagisawa et al. | |
| 7,028,680 | B2 * | 4/2006 | Liu et al. | 123/568.17 |
| 7,032,578 | B2 * | 4/2006 | Liu et al. | 123/568.15 |
| 7,140,357 | B2 * | 11/2006 | Wei et al. | 123/568.17 |
| 7,290,504 | B2 | 11/2007 | Lange | |
| 7,389,770 | B2 | 6/2008 | Bertilsson | |
| 7,721,541 | B2 | 5/2010 | Roberts, Jr. et al. | |
| 7,945,376 | B2 | 5/2011 | Geyer et al. | |
| 7,945,377 | B1 | 5/2011 | Van Nieuwstadt et al. | |
| 2002/0189598 | A1 | 12/2002 | Remmels et al. | |
| 2003/0121484 | A1 | 7/2003 | Wang | |
| 2004/0099256 | A1 | 5/2004 | Stewart | |
| 2005/0022450 | A1 | 2/2005 | Tan et al. | |
| 2006/0112940 | A1 | 6/2006 | Roberts et al. | |
| 2007/0193270 | A1 | 8/2007 | Roozenboom et al. | |
| 2009/0199825 | A1 | 8/2009 | Piper et al. | |
| 2009/0308070 | A1 | 12/2009 | Alger, II et al. | |
| 2011/0041495 | A1 | 2/2011 | Yager | |
| 2012/0167863 | A1 * | 7/2012 | Kulkarni | 123/568.17 |
| 2012/0216530 | A1 * | 8/2012 | Flynn et al. | 60/605.2 |

OTHER PUBLICATIONS

International Preliminary Report on Patentability dated May 8, 2007 issued in International Patent Application No. PCT/US0540483.

U.S. Office Action dated May 28, 2013 issued in related U.S. Appl. No. 13/025,901.

* cited by examiner

EGR DISTRIBUTOR APPARATUS FOR DEDICATED EGR CONFIGURATION

FIELD OF THE INVENTION

The present disclosure relates to internal combustion engines, and more particularly, to improved exhaust gas recirculation (EGR) for such engines which may be used in motor vehicles.

BACKGROUND

For conventional low level exhaust gas recirculation (EGR), exhaust gas expelled from the cylinders of an internal combustion engine may be collected in a collector of an exhaust manifold. A fraction of the collected exhaust gas (e.g. 5% to 10%) may then be routed from the exhaust manifold through a control valve back to an intake manifold of the engine, where it may be introduced to a stream of ambient air/fuel (A/F) mixture. The remaining fraction of exhaust gas in the exhaust manifold, rather than being recirculated and recycled, generally flows to a catalytic converter of the exhaust system and, after treatment therein, may be expelled to the atmosphere.

EGR has a history of use in both diesel and spark-ignition engines, and affects combustion in several ways. The combustion may be cooled by the presence of exhaust gas, that is, the recirculated exhaust gas may absorb heat. The dilution of the oxygen present in the combustion chamber with the exhaust gas, in combination with the cooler combustion, may reduce the production of mono-nitrogen oxides (NOx), such as nitric oxide (NO) and nitrogen dioxide ($NO_2$). Also, when exhaust gas is recirculated, less air may be breathed by the engine, which may reduce the amount of exhaust gas produced. Additionally, EGR may reduce the need for fuel enrichment at high loads in turbocharged engines and thereby improve fuel economy.

EGR which uses higher levels of exhaust gas may further increase fuel efficiency and reduce emissions of spark-ignition engines. However, with higher levels of exhaust gas, engines may face challenges related to EGR control and tolerance, which may reduce the expected fuel efficiency improvement. Challenges related to EGR control may be understood to include reducing a variability of the exhaust gas, particularly composition and distribution. If a variation in the exhaust gas introduced to an engine is too random, fuel efficiency improvements may suffer. Challenges related to EGR tolerance may be understood to include increasing an engine's ability to process higher levels of exhaust gas without adversely affecting performance, particularly fuel economy. Thus, even if EGR control and tolerance may be satisfactory for engine operation at low levels of EGR, an engine may need additional modifications in structure and operational conditions to accommodate higher levels of EGR without adversely affecting engine performance.

More recently, an engine configuration has been proposed with one or more cylinders of an engine dedicated to expelling exhaust gas for EGR. Such cylinders may be referred to as dedicated EGR, or D-EGR, cylinders. Dedicated EGR cylinder(s) may operate at a broad range of equivalence ratios since their exhaust gas is generally not configured to exit the engine before passing through a cylinder operating at, for example, a stoichiometric or near stoichiometric air/fuel ratio. This may allow the dedicated EGR cylinder to be run rich to produce higher levels of hydrogen ($H_2$) and carbon monoxide (CO) which, may in turn, enhance flame speeds, combustion, and knock tolerance of all the cylinders.

SUMMARY

The present disclosure expands upon the use of engines with one or more dedicated EGR cylinders, by providing configurations of systems, apparatuses and methods to further control an operation of a dedicated EGR cylinder independent of the remaining cylinders, as well as further control the exhaust gas expelled from the dedicated EGR cylinder. For example, for an engine having a dedicated EGR cylinder, configurations of systems, apparatuses and methods are provided to restrict an amount of exhaust gas consumed by the dedicated EGR cylinder without necessarily restricting an amount of exhaust gas consumed by the remaining cylinders. Furthermore, for example, configurations of systems, apparatuses and methods are provided to improve mixing and distribution of dedicated EGR cylinder exhaust gas introduced to a stream of intake air, which may improve EGR control and tolerance.

According to one embodiment of the present disclosure, an exhaust gas recirculation apparatus is provided to distribute recirculated exhaust gas in an air stream to be introduced to an internal combustion engine, with the apparatus comprising an intake passage defined by a wall structure, the wall structure including a plurality of apertures therein configured to distribute recirculated exhaust gas into the intake passage.

According to another embodiment of the present disclosure, a system to manage exhaust gas expelled from cylinders of an internal combustion engine is provided comprising an intake system including an exhaust gas recirculation apparatus to distribute recirculated exhaust gas in an air stream to be introduced to an internal combustion engine, with the apparatus comprising a first inlet to receive ambient air, a second inlet to receive recirculated exhaust gas, and an outlet to provide a mixture of the air and the recirculated exhaust gas, the air-exhaust gas mixture to be provided to the internal combustion engine through an intake manifold; and an intake passage between the first inlet and the outlet, and defined by a wall structure, the wall structure including a plurality of apertures therein to distribute the recirculated exhaust gas into the intake passage.

According to another embodiment of the present disclosure, a method to distribute recirculated exhaust gas in an air stream to be introduced to an internal combustion engine is provided, with the method comprising providing an exhaust gas recirculation apparatus having a first inlet to receive ambient air, a second inlet to receive recirculated exhaust gas, and an outlet to provide a mixture of the air and the recirculated exhaust gas, the air-exhaust gas mixture to be provided to the internal combustion engine through an intake manifold, and an intake passage between the first inlet and the outlet, and defined by a wall structure, the wall structure including a plurality of apertures therein to distribute the recirculated exhaust gas into the intake passage; introducing ambient air into the intake passage from the first inlet; and distributing recirculated exhaust gas into the intake passage through the plurality of apertures to provide a mixture of air and recirculated exhaust gas.

FIGURES

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
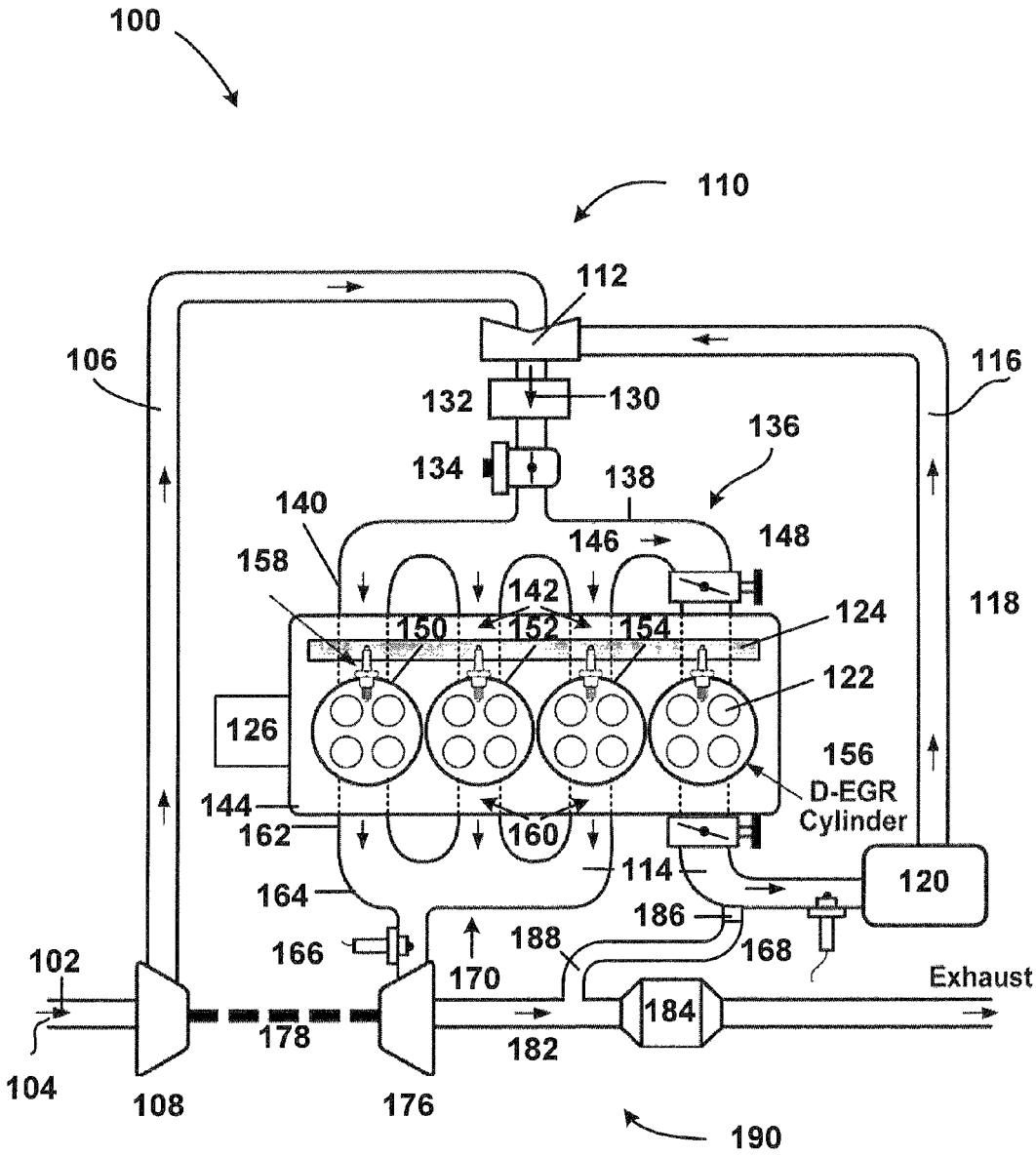
FIG. 1 is a schematic drawing of an inline four cylinder engine with a dedicated exhaust gas recirculation (D-EGR) cylinder, and an exhaust gas recirculation system with a flow restrictor configured and arranged to restrict a flow of recirculated exhaust gas to the dedicated EGR cylinder without restricting the flow of recirculated exhaust gas to the remaining cylinders of the engine.

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

The following description is directed to various configurations of exhaust gas recirculation (EGR) systems, apparatuses and methods, to be used with an internal combustion engine. With the EGR configurations, one or more cylinders of the internal combustion engine may be used to generate exhaust gas, which may then be recirculated and mixed with an intake stream of air to provide a mixed charge (mixture) of exhaust gas and air to the cylinders of the engine. For the purposes of this disclosure, an engine configured such that substantially an entire output of exhaust gas from a cylinder is to be recirculated for EGR may be referred to herein as an engine having a dedicated EGR cylinder.

FIG. 1 illustrates an internal combustion engine 100 having four cylinders 150, 152, 154 and 156. One of the cylinders, cylinder 156, may be understood to be a dedicated EGR cylinder. In other words, it may be understood that substantially all of the exhaust gas expelled from cylinder 156 may be directed (recirculated) back to the intake system 110, here through an EGR feedback loop 118. The exhaust gas from the remaining three cylinders 150, 152, and 154 is directed to an exhaust system 190, with none of the exhaust gas expelled from cylinders 150, 152 and 154 recirculated to the intake system 110 of engine 100.

While it may be possible, based on the configuration of engine 100, for all of the exhaust gas (i.e. 100%) expelled from cylinder 156 to be optimally recirculated back to the intake system 110, it should be understood that certain design considerations and operating inefficiencies may only allow substantially all the exhaust gas expelled from cylinder 156 to be recirculated back to the intake system 110. For example, exhaust gas losses may occur between connection points (e.g. loop 118 and cylinder head 144), or other connection points between separate components. Accordingly, it is contemplated that on a volume basis, 90% or more of the exhaust gas expelled from the dedicated EGR cylinder is recirculated to the engine intake system 110. More preferably, 90-100% of the exhaust gas expelled from cylinder 156 is recirculated, including all values therein, in 0.1% by volume increments.

Furthermore, engine 100 may also be understood to have a maximum "25% dedicated EGR" because the exhaust gas expelled from each cylinder may be understood to have substantially the same volume, and one of the four cylinders has 100% of its exhaust gas redirected to the intake system 110, as noted above.

During an operation of engine 100, ambient intake air 102 may enter air inlet 104 of air intake system 110. The air 102 may then travel within intake passage 106, during which time it may be compressed by compressor 108. Thereafter, air 102 may enter distributor/mixer apparatus 112 of air intake system 110, which provides an exhaust gas recirculation apparatus configured to distribute and mix recirculated exhaust gas 114 in a stream of air 102 to be introduced to the internal combustion engine 100, particularly statically (with no moving structure).

Also with the operation of engine 100, exhaust gas 114 from dedicated EGR cylinder 156 may enter passage 116 of EGR feedback loop 118. Thereafter, exhaust gas 114 may enter distributor/mixer apparatus 112 of the air intake system 110 and be distributed and mixed with a stream of air 102 to provide a mixture 130 thereof.

Prior to entering distributor/mixer apparatus 112, one or more components of the exhaust gas 114 may react with water using a water gas shift reaction (WGSR) with a suitable water gas shift (WGS) catalyst 120. With the WGS reaction, carbon monoxide (CO) in the exhaust gas 114 may react with water ($H_2O$) to produce carbon dioxide ($CO_2$) and hydrogen ($H_2$) according to the reaction:

$$CO+H_2O \rightarrow CO_2+H_2$$

Reacting carbon monoxide in the exhaust gas 114 with water to produce hydrogen is beneficial by increasing the amount of hydrogen in the exhaust gas 114 from dedicated EGR cylinder 156. The WGS catalyst 120 performance is highly dependent on exhaust temperature, and the amount of hydrogen exiting the catalyst 120 is dependent on the amount entering and the amount created. The amount of hydrogen entering the catalyst 120 is a function of the dedicated EGR cylinder air/fuel ratio and spark timing. The amount of hydrogen created is dependent on exhaust gas temperature and the amount of carbon monoxide in the inlet exhaust. Both can be manipulated with the dedicated EGR cylinder air/fuel ratio. Therefore, for a given operating condition, the dedicated EGR cylinder air/fuel ratio can be controlled to maximize the amount of $H_2$ exiting the WGS catalyst 120. Examples of WGS catalysts may include iron oxides ($Fe_3O_4$) or other transition metals and transition metal oxides.

After distributor/mixer apparatus 112, air/exhaust gas mixture 130 may then flow in passage 106 to intercooler 132 to remove heat therefrom and correspondingly increase the density thereof. After being cooled by intercooler 132, air/exhaust gas mixture 130 may then flow to an intake flow restrictor 134, such as an intake throttle valve (a mechanism which by which a flow of the air/exhaust gas mixture 130 is managed by restriction or obstruction) configured to restrict the volumetric flow and amount (mass) of air/exhaust gas mixture 130 provided to cylinders 150, 152, 154 and 156. The intake throttle valve may more particularly comprise a butterfly valve that restricts the flow and amount of air/exhaust gas mixture 130 entering the intake manifold 136 and ultimately provided to cylinders 150, 152, 154 and 156. Intake flow restrictor 134 may be considered to be a primary flow restrictor in that it may similarly restrict the flow of the air/exhaust gas mixture 130 to all of cylinders 150, 152, 154 and 156.

Intake flow restrictor 134 may be located at the entrance of intake manifold 136. Intake manifold 136 may comprise a plenum 138 through which the air/exhaust gas mixture 130 may flow to a plurality of intake passages/runners 140, shown with one passage/runner 140 dedicated to each cylinder 150-156. Each passage/runner 140 may then feed the air/exhaust gas mixture 130 directly into an intake port 142 (shown by dotted lines) of a cylinder head 144, shown with one port 142 dedicated to each cylinder 150-156.

After entering cylinders 150-156, the air/exhaust gas mixture 130 may be ignited by igniter 158 (e.g. spark plug) and combust therein. After combustion of the air/exhaust gas mixture 130 within cylinders 150-156, exhaust gas 114 from cylinders 150, 152 and 154 may flow through exhaust ports 160 of cylinder head 144 and exhaust passages/runners 162 of exhaust manifold 170, shown with one exhaust port 160 and one passage/runner 162 dedicated to each cylinder 150-154, and then be collected in collector 164.

From collector 164, exhaust gas 114 may then flow through turbine 176, which may turn compressor 108 by shaft 178. After turbine 176, exhaust gas 114 may flow through exhaust passage 182 to catalytic converter 184 to be treated therein before being expelled from exhaust system 190 and into the atmosphere. Catalytic converter 184 may comprise a three-way catalytic converter. In other words, a catalytic converter which performs the following:

Reduction of nitrogen oxides to nitrogen and oxygen by the reaction:

$$2NO_x \rightarrow O_2+N_2.$$

Oxidation of carbon monoxide to carbon dioxide by the reaction:

$$2CO+O_2 \rightarrow 2CO_2.$$

Oxidation of unburnt hydrocarbons (HC) to carbon dioxide and water by the reaction:

$$C_xH_{2x+2}+[(3x+1)/2]O_2 \rightarrow xCO_2+(x+1)H_2O.$$

To control the air/fuel ratio, exhaust gas 114 from cylinders 150, 152 and 154 may be sampled by an exhaust gas oxygen (EGO) sensor 166, which may more particularly comprise a heated exhaust gas oxygen (HEGO) sensor, while exhaust gas 114 from cylinder 156 may be sampled by an exhaust gas oxygen (EGO) sensor 168, which may more particularly comprise a universal exhaust gas oxygen (UEGO) sensor.

To control the mass and volumetric flow rate of the air/exhaust gas mixture 130 entering dedicated EGR cylinder 156, the portion of the intake passage 146 dedicated to cylinder 156 may include an intake charge flow restrictor 148, such as a throttle valve, configured and arranged to restrict the flow and amount of air/exhaust gas mixture 130 entering cylinder 156 without restricting the flow and amount of air/exhaust gas mixture 130 entering remaining cylinders 150, 152 or 154. The throttle may more particularly comprise a butterfly valve that restricts the amount of air/exhaust gas mixture 130 entering cylinder 156. Flow restrictor 148 may be considered to be a secondary flow restrictor in that it may restrict the flow of the air/exhaust gas mixture 130 to a particular cylinder, here cylinder 156, as opposed to all the cylinders, after the air/exhaust gas mixture 130 has flowed past primary flow restrictor 134.

As shown in FIG. 1, flow restrictor 148 may be located on the intake side of cylinder 156 for intake restriction, or on the exhaust side of cylinder 156 for exhaust restriction. However, it may be expected that flow restrictor 148 would be better positioned on the intake side of cylinder 156 to reduce back pressure thereon which may be associated with use of flow restrictor 148 on the exhaust side of cylinder 156. When positioned on the intake side of engine 100, flow restrictor 148 may be attached to the intake manifold 136, or arranged between the intake manifold 136 and the cylinder head 144. When positioned on the exhaust side of engine 100, flow restrictor 148 may be attached to the exhaust passage 166, or located between the exhaust passage 116 and the cylinder head 144.

With the foregoing configuration, as flow restrictor 148 may be at least partially closed, the flow and amount of air/exhaust gas mixture 130 entering cylinder 156 may be decreased. Simultaneously, the air/exhaust gas mixture 130 entering cylinders 150, 152 and 154 may be increased, provided flow restrictor 134 remains unchanged. Thus, the flow and amount of the air/exhaust gas mixture 130 entering cylinder 156 may be inversely related to the flow and amount of the air/exhaust gas mixture 130 entering cylinders 150, 152 and 154. That is, as the flow and amount of the air/exhaust gas mixture 130 entering cylinder 156 may be decreased, the flow and amount of the air/exhaust gas mixture 130 entering cylinders 150, 152 and 154 may be increased, and vice-versa.

As indicated above, without the use of flow restrictor 148, the engine 100 in FIG. 1 may be understood to have "25% dedicated EGR" because the exhaust gas expelled from each cylinder 150-156 may be understood to have substantially the same volume, and one of the four cylinders, cylinder 156, has 90-100% by volume of its exhaust gas redirected to the intake manifold 136. However, with the use of flow restrictor 148, the volume of exhaust gas expelled from cylinder 156 may now be varied by restricting the amount of air/exhaust gas 130 which is consumed by cylinder 156 such at the engine 100 may provide, for example, between 0.1% and 25% dedicated EGR. By decreasing the flow and amount of air/exhaust gas 130 which is consumed by cylinder 156, the flow and amount of exhaust gas 114 expelled from cylinder 156 and routed through EGR loop 118 to air intake system 110 may be correspondingly decreased, which will decrease amount of exhaust gas 114 provided to the cylinders 150-156.

Furthermore, flow restrictor 148 may be used in conjunction with valves 122, fuel injector 124 and engine controller 126 of engine 100 to operate or otherwise control dedicated EGR cylinder 156 at the same or different air/fuel ratio than cylinders 150, 152 and 154. Further, each cylinder 150-156 may be independently operated at an air/fuel ratio which is greater than (rich), equal to, or less than (lean) a stoichiometric ratio for the air and fuel.

In the event flow restrictor 148 becomes inoperable, or for other reason there is too much exhaust gas 114 introduced into EGR loop 118, it may be desirable to bleed off a portion of the exhaust gas 114 from EGR loop 118. As shown, the EGR loop 118 may be equipped with a bleeder valve 186 which may, upon reaching a predetermined pressure, bleed off excess exhaust gas 114 from cylinder 156 to bypass passage 188 which removes exhaust gas 114 from EGR loop 118. In the foregoing manner, bleeder valve 186 may provide another means other than flow restrictor 148 to control the EGR mass flow back to the intake. Bypass passage 188 may then feed the exhaust gas into exhaust passage 182 prior to catalytic converter 184 to be treated therein before being expelled from exhaust system 190 and into the atmosphere.

If dedicated EGR cylinder 156 is run rich of stoichiometric A/F ratio, a relatively significant amount of hydrogen ($H_2$) and carbon monoxide (CO) may be formed, both of which may promote increased EGR tolerance by increasing burn rates, increasing the dilution limits of the mixture and reducing quench distances. In addition, the engine 100 may perform better at knock limited conditions, such as improving low speed peak torque results, due to increased EGR tolerance and the knock resistance provided by hydrogen ($H_2$) and carbon monoxide (CO). Also, if exhaust gas 114 from one or more cylinders 156 is redirected to the intake manifold 136, and the cylinder 156 is run at rich of stoichiometric A/F ratios (i.e. Phi(Φ)>1.0), the EGR tolerance of the engine 100 may now increase while the overall fuel consumption may decrease.

It therefore may now be appreciated that in one exemplary embodiment the present disclosure provides methods and systems to manage exhaust gas 114 expelled from cylinders 150-156 of an internal combustion engine 100, with the method comprising operating at least one cylinder of the engine 100 as a dedicated exhaust gas recirculation (EGR) cylinder 156, and wherein substantially all exhaust gas 114 expelled from the dedicated EGR cylinder 156 is recirculated to an intake system 110 of the engine 100, and controlling a flow of the recirculated exhaust gas 114 during operation of the engine 100 with at least one flow restrictor 148, wherein the flow restrictor 148 is configured and arranged to restrict a flow of the recirculated exhaust gas 114 to the dedicated EGR cylinder 156 without restricting a flow of the recirculated exhaust gas 114 to the remaining cylinders 150, 152 and 154 of the engine 100.

In addition to the above it may now be mentioned that flow restrictor 148, alone or in conjunction with an ability to control cylinder spark timing independently, may be further employed to balance a power output and combustion phasing of the dedicated EGR cylinder 156 with the remaining cylinders 150, 152 and 154. This may then inhibit torque imbalances on a crankshaft of the engine. Moreover, other techniques which may be used to alter the percentage of EGR for engine 100 having a dedicated EGR cylinder 156 (by changing the mass flow through the dedicated EGR cylinder 156 relative to the other cylinders 150, 152 and 154) may include dedicated EGR intake or exhaust valve phasing, as well as changes to the dedicated EGR cylinder bore, stroke, and compression ratio in comparison to the other cylinders.

Due to dedicated EGR cylinder 156 being the only cylinder expelling exhaust gas 114 which is recirculated to intake system 110 of engine 100, the exhaust gas 114 may be recirculated to intake system 110 in pulsations, rather than a continuous flow. A pulsation may be understood as an increase in exhaust gas flow and associated pressure relative to some baseline condition. For example, during the operation of engine 100, cylinder 156 may be understood to expel exhaust gas 114 during the exhaust stroke thereof, but not during the intake, compression and combustion strokes. Thus, since cylinder 156 may expel exhaust gas 114 during one of its four strokes, the exhaust gas 114 may be expelled in pulsations occurring with the exhaust stroke. More particularly, the engine 100 may experience pulsed exhaust gas 114 flow due to the valve events of the dedicated EGR cylinder 156 and dynamic pressure wave reflections in the dedicated EGR cylinder exhaust passage 116.

Figure 2:
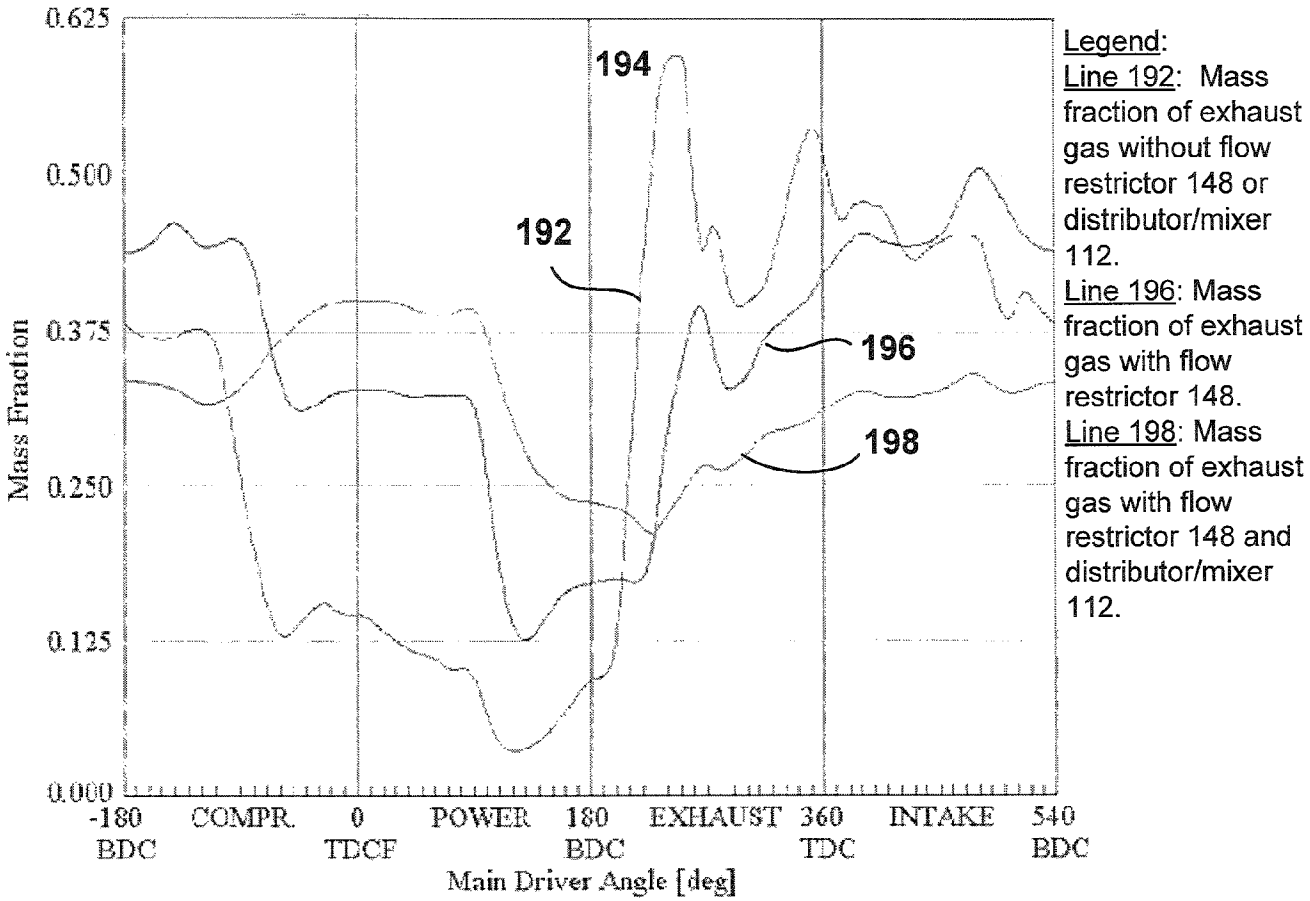
FIG. 2 is a schematic drawing showing variation of exhaust gas mass fraction in a stream of air during one operating cycle of an engine with a dedicated EGR cylinder with and without use of an apparatus according to the present disclosure.

An example of the exhaust gas pulsations may be seen in FIG. 2. Line 192 of FIG. 2 shows a pulsation 194 of exhaust gas 114 within air/exhaust gas mixture 130 after exhaust gas 114 has been introduced to stream of air 102. As a result, the distribution of exhaust gas 114 in the air/exhaust gas mixture 130 may be considered to be poor due to the pulsed flow of the exhaust gas 114 entering the stream of air 102.

As shown by line 196, with the use of flow restrictor 148, the peaks and troughs (amplitude) of pulsations 194 of exhaust gas 114 in air/exhaust gas mixture 130 may be reduced as compared to line 192. However, when exhaust gas 114 may be introduced to stream of air 102, the air/exhaust gas mixture 130 may still have exhaust gas 114 therein resulting in variations unacceptable for control and tolerance of high EGR levels. For example, the air/exhaust gas mixture 130 may have a temporal distribution of exhaust gas 114 therein where, for a given length of the air intake passage 106, the concentration/distribution of the exhaust gas 114 may vary along the length in accordance with the exhaust gas pulsations. Similarly, the air/exhaust gas mixture 130 may have a radial distribution of exhaust gas 114 therein where, for a given cross-sectional area of the air intake passage 106, the concentration/distribution of the exhaust gas 114 may vary from the middle/center to the outer boundary of the passage in accordance with the exhaust gas pulsations.

Figure 3:
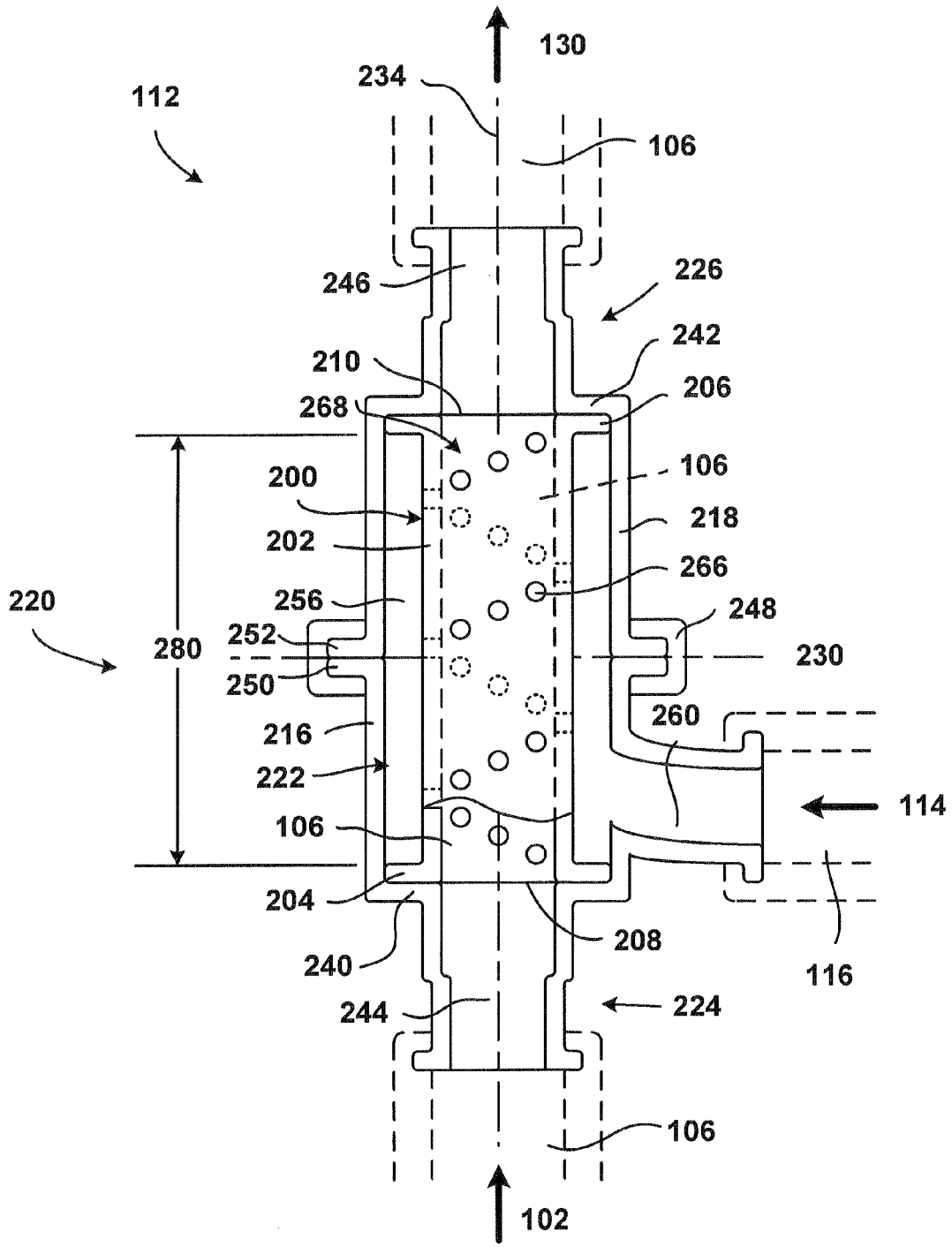
FIG. 3 is a schematic drawing of one embodiment of an exhaust gas recirculation apparatus according to the present disclosure to distribute recirculated exhaust gas in an air stream to be introduced to an internal combustion engine to reduce variation/increase distribution of exhaust gas mass fraction in an intake stream of air.

In order to decrease the variation and increase the distribution of the exhaust gas 114 within air/exhaust gas mixture 130, to better ensure that all of cylinders 150-156 receive a same dilution level of exhaust gas 114 mixed with air 102 during operation of engine 100, the intake system 110 may be equipped with a distributor/mixer apparatus 112 as shown in FIG. 3. As shown by line 198 in FIG. 2, with use of the distributor/mixer apparatus 112 of the present disclosure, the peaks and troughs (amplitude) of pulsations 194 of exhaust gas 114 in air/exhaust gas mixture 130 may be further reduced as compared to line 196. More particularly, the absolute value of the displacement from peak to trough and the corresponding amplitude maximum value of the displacement of the exhaust gas oscillation shown have been reduced.

As shown in FIG. 3, distributor/mixer apparatus 112 may comprise an elongated tubular inner member 200 having a circular (cylindrical) side wall structure 202 which extends between opposing end (annular) flanges 204 and 206 and defines a portion of intake passage 106 between opposing ends which provide an inlet 208 to receive ambient air 102 and outlet 210 to provide (discharge) air/exhaust gas mixture 130 to the internal combustion engine 100 through intake manifold 136, both of which are connectable to upstream and down steam portions of the intake passage 106 as may be required.

Inner member 200 may be configured to fit within a receptacle 222 within an outer member 220, which may be cylindrical, which surrounds inner member 200. Outer member 220 may comprise first and second mating components 224 and 226 which form receptacle 222 and provide a shell around inner member 200. First component 224 and second component 226 may be configured in such fashion that inner member 200 may be inserted and removed from receptacle 222 when the first component 224 and the second component 226 are separated along a parting line 230 in the direction of longitudinal axis 234 of inner member 200 and outer member 220.

When located within receptacle 222, and first component 224 and second component 226 are properly assembled, inner member 200 may be held in proper position between annular shoulder 240 of first component 224 opposing annular flange 204 at one end 208 thereof, and annular shoulder 242 of second component 226 opposing annular flange 206 at the other end 210 thereof. Furthermore, when inner member 200 is properly assembled, inlet end 208 of inner member 200 is aligned with inlet passage 244 of first component 224 and outlet end 210 of inner member 200 is aligned with outlet passage 246 of second component 226. First component 224 and second component 226 may then be mechanically fastened together by a removable C-shaped circular locking ring 248 which captures mating annular flanges 250 and 252 of first and second components 224 and 226, respectively.

Within cylindrical receptacle 222, a cylindrical exhaust gas chamber 256 may be formed around the outside of inner member 200 between inner member side wall structure 202 and side wall structures 216 and 218 of first and second components 224 and 226, respectively. As shown, exhaust gas chamber 256 completely surrounds intake passage 106 along its length and is separated from intake passage 106 by wall structure 202 of inner member 200, with intake passage 106 located to an inner side of side wall structure 202, and exhaust gas chamber 256 located to an outer side of side wall structure 202. As intake passage 106 and exhaust gas chamber 256 of outer member 200 are shown to share a common longitudinal axis 234, intake passage 106 and exhaust gas chamber 256 may be understood to be coaxially arranged, with exhaust gas chamber 256 having an annular shape and intake passage 106 having a cylindrical (non-annular) shape.

Exhaust gas chamber 256 may be configured to receive recirculated exhaust gas 114 through exhaust gas inlet 260 which is in fluid communication with exhaust gas recirculation passage 116. Thereafter, the exhaust gas 114 may flow into chamber 256 and then exit chamber 256 through a plurality of apertures 266 formed in side wall structure 202 of inner member 200 to distribute recirculated exhaust gas 114 into the intake passage 106. Upon passing through apertures 266, the exhaust gas 114 may enter intake passage 106 and mix with air 102 therein to thereafter provide the air/exhaust gas mixture 130. As shown in FIG. 3, exhaust gas inlet 260 may be positioned closer to inlet 208 of inner member 200 (upstream) than outlet 210 of inner member 200 (downstream) relative to the length of inner member 200. Furthermore, exhaust gas inlet 260 may feed exhaust gas 114 into exhaust gas chamber 256 at an orientation perpendicular to a length of chamber 256.

In order to ensure the proper direction of flow for air 102 and exhaust gas 114, recirculation loop 118 may be configured such that normal operating pressures of exhaust gas 114 in recirculation passage 116 and chamber 256 are slightly greater than the normal operating pressures of the air 102 within air intake passage 106. In this manner, the greater pressure of the exhaust gas 114 will ensure a flow of exhaust gas 114 out of chamber 256 through apertures 266 and into air intake passage 106 rather than a flow of air 102 in the wrong direction into chamber 256.

Among other things, apertures 266 are configured and arranged to distribute recirculated exhaust gas 114 into the air intake passage 106. More particularly, apertures 266 may be configured and arranged to dampening the pulsations of exhaust gas 114 from D-EGR cylinder 156 in such a manner that variations in temporal (longitudinal) and radial distribution of exhaust gas 114 into the air intake passage 106 as a result of the pulsations may be increased.

As shown in FIG. 3, apertures 266 may be arranged in a helical pattern 268 along a length 280 (longitudinally in direction of axis 234) of the side wall structure 202 and air intake passage 106. By using the helical pattern 268 shown, apertures 266 are arranged and distributed along a longitudinal length 280 of the intake passage 106 of inner member 200 and axis 234, as well as around the perimeter (here, circumference) of intake passage 106 of inner member 200 and axis 234. Furthermore, apertures 266 are arranged to expel exhaust 114 gas radially towards longitudinal axis 234 of the intake passage 106 in an effort to maximize interaction between the exhaust gas 114 and air 102. In the foregoing manner, both the temporal and radial mixing of exhaust gas 114 may be respectively increased in the air 102 within intake passage 106.

In addition to the foregoing, it should be understood that dampening the pulsations of exhaust gas 114 from D-EGR cylinder 156 in such a manner that variations in temporal (longitudinal) and radial distribution of exhaust gas 114 into the air intake passage 106 are decreased may be accomplished with other geometric patterns of apertures 266 other than the helical pattern shown in FIG. 3.

Figure 4:
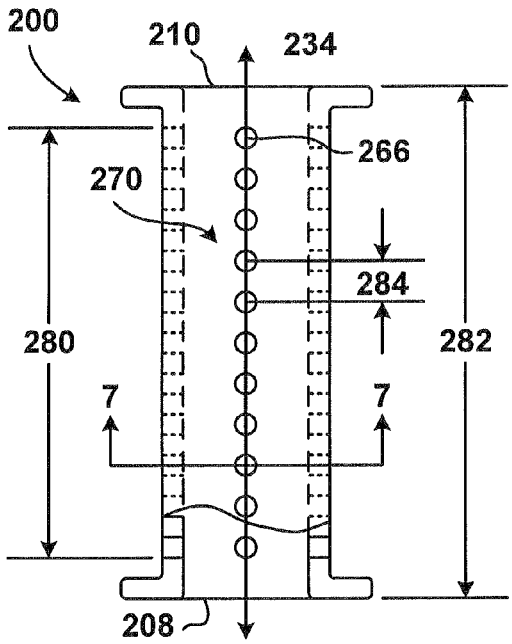
FIG. 4 is a schematic drawing of another embodiment of an exhaust gas recirculation apparatus according to the present disclosure.
Figure 5:
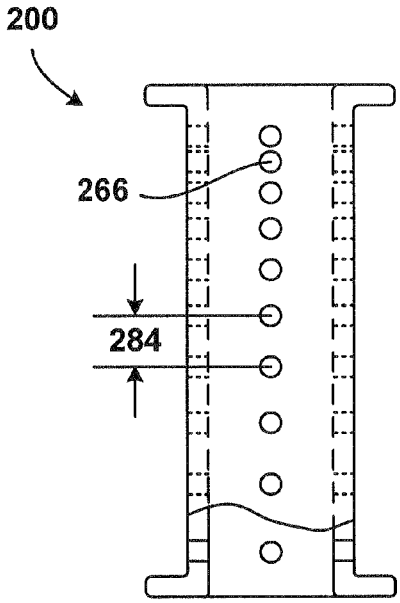
FIG. 5 is a schematic drawing of another embodiment of an exhaust gas recirculation apparatus according to the present disclosure.
Figure 6:
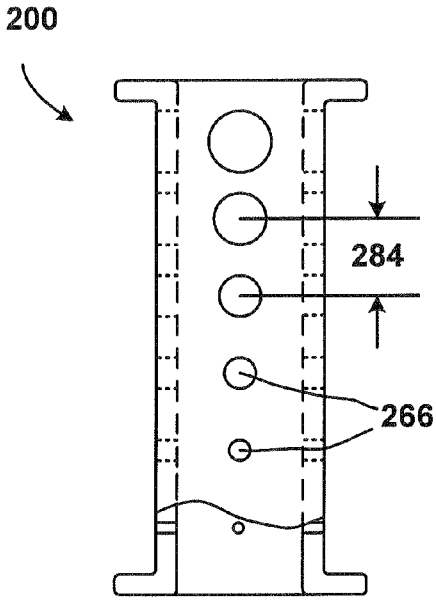
FIG. 6 is a schematic drawing of another embodiment of an exhaust gas recirculation apparatus according to the present disclosure.

For example, as shown in FIG. 4-6, apertures 266 may be arranged in one or more straight rows 270 which are arranged along the longitudinal length 280 of the intake passage 106 of inner member 200 and axis 234. More particularly, rows 270 are arranged parallel with the longitudinal length 280 of the intake passage 106 of inner member 200 and axis 234. In the foregoing manner, variations in temporal (longitudinal) distribution of exhaust gas 114 into the air intake passage 106 may be decreased.

Referring to FIG. 5, recognizing that the length of chamber 256 may experience a drop in pressure as the distance from exhaust gas inlet 260 increases, the distance between the apertures 266 may decrease, as shown by a decrease in as the center-to-center distance 284, as the distance away from exhaust gas inlet 260 increases, such that the apertures 266 may be spaced closer together as the inner member 200 extends from inlet end 208 to outlet end 210. Such a pattern of apertures 266 may compensate for a pressure drop such that the exhaust gas 114 expelled from the apertures 266 from inlet end 208 to outlet end 210 is more uniform than with the row 270 of apertures 266 of FIG. 4.

Alternatively, as shown in FIG. 6, apertures 266 may increase in size as the inlet member 200 extends from inlet end 208 to outlet end 210, with the center-to-center distance 284 remaining constant. Such a pattern of apertures 266 may also compensate for a pressure drop such that the exhaust gas 114 expelled from the apertures 266 from inlet end 208 to outlet end 210 is more uniform than with the row 270 of apertures 266 of FIG. 4.

Figure 7:
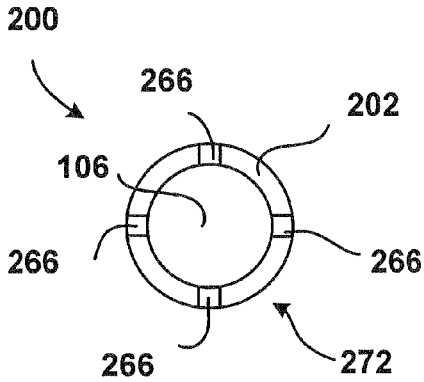
FIG. 7 is a schematic drawing of a cross-section of the exhaust gas recirculation apparatus of FIG. 4 taken along line 7-7.

As best shown in FIG. 7, the rows 270 of apertures 266 shown in FIGS. 4-6 are arranged around the perimeter (circumference) of intake passage 106 of inner member 200 to further provide a plurality of rings 272 of apertures 266. As shown in FIG. 7, ring 272 is formed by one aperture 266 from each of four rows 270, which are equally spaced from one another at 90 degree intervals around the perimeter (circumference) of intake passage 106 of inner member 200 and axis 234. In the foregoing manner, variations in radial distribution of exhaust gas 114 into the air intake passage 106 may be decreased.

Figure 8:
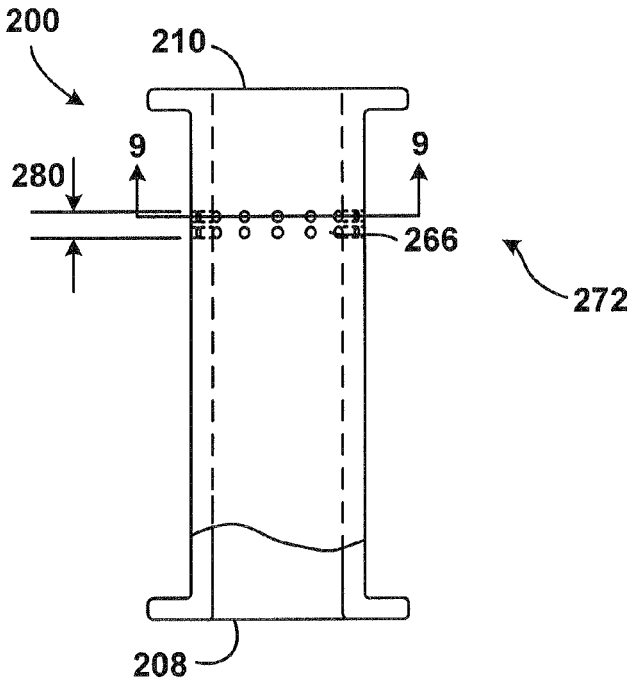
FIG. 8 is a schematic drawing of another embodiment of an exhaust gas recirculation apparatus according to the present disclosure.
Figure 9:
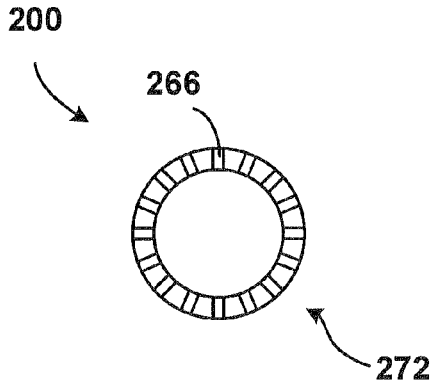
FIG. 9 is a schematic drawing of a cross-section of the exhaust gas recirculation apparatus of FIG. 8 taken along line 9-9.

Referring now to FIG. 8, there is shown an inner member with two rings 272 of apertures 266, with a cross-section of a ring 272 shown in FIG. 9. As shown in FIG. 8, the distance 280 measures the longitudinal length between the beginning of apertures 266 of the first ring 272 (i.e. closest to inlet end 208) and end of apertures 266 of the second ring 272 (i.e. closest to outlet end 210). Here, the longitudinal length 280 of the apertures 266 from beginning to end is 5% of the overall longitudinal length 282 of inner member 200. In comparison, the longitudinal length 280 of the apertures 266 from beginning to end in FIG. 3 is in excess of 90% of the overall longitudinal length 282 of inner member 200. Thus, as it may be appreciated that a longitudinal length 280 of the apertures may be in a range of and any increment between 5% to 90% of an overall longitudinal length 280 of the inner member 200.

As shown in FIG. 9, ring 270 comprises 16 apertures, which are equally spaced from one another at 22.5 degree intervals around the perimeter (circumference) of intake passage 106 of inner member 200 and axis 234. More apertures 266 may be used at smaller interval spacing as suitable. However, generally an interval spacing in the range of and any increment between 15 degrees to 90 degrees may be sufficient.

Figure 10:
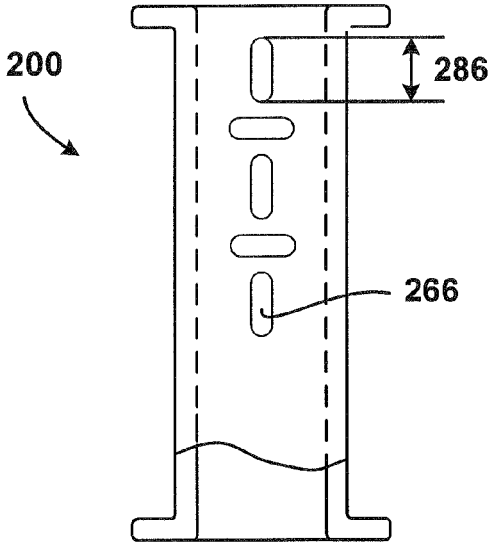
FIG. 10 is a schematic drawing of another embodiment of an exhaust gas recirculation apparatus according to the present disclosure.

As shown in FIG. 10, apertures 266 may be oblong, for example, in the form of slots arranged with either their length 286 along a longitudinal length of the intake passage 106 or their length 286 around a perimeter (circumference) of the intake passage 106 of inner member 200 and axis 234.

It may be appreciated that the size (area) of an aperture 266 will vary with, among other things, the total number of apertures 266 and the displacement of the engine 100. In the case of a circular aperture, for example, the area A may be calculated by the formula:

$$A=(\pi)(r^2)$$

where A is the area, π, or Pi, is the mathematical constant 3.14 and r is the radius of the circle.

Generally, the cross-sectional area of an aperture 266 may be expected to be 5 $mm^2$ or greater. For example, an aperture 266 may have a cross-sectional area in a range of and all increments between 10 $mm^2$ to 1000 $mm^2$. More particularly, an aperture 266 may have a cross-sectional area in a range of and all increments between 20 $mm^2$ to 500 $mm^2$. More particularly, an aperture 266 may have a cross-sectional area in a range of and all increments between 40 $mm^2$ to 200 $mm^2$. More particularly, an aperture 266 may have a cross-sectional area in a range of and all increments between 60 $mm^2$ to 100 $mm^2$. Even more particularly, an aperture 266 may have a cross-sectional area of 80 $mm^2$.

It may also be appreciated that the total area of all the apertures 266 (i.e. the sum of the individual area for each aperture 266) may be a function of the total area of the exhaust port(s) 160 for dedicated EGR cylinder(s) 156 of engine 100, such that some back pressure may be created, but not enough back pressure to adversely affect performance of the engine 100. For example, the total area of all the apertures 266 may be in a range of and all increments between 25% to 200% of the total area of the exhaust port(s) 160 for dedicated EGR cylinder(s) 156 of engine 100. More particularly, the total area of all the apertures 266 may be in a range of and all increments between 50% to 150% of the total area of the exhaust port(s) 160 for dedicated EGR cylinder(s) 156 of engine 100. More particularly, the total area of all the apertures 266 may be in a range of and all increments between 75% to 125% of the total area of the exhaust port(s) 160 for dedicated EGR cylinder(s) 156 of engine 100.

Figure 11:
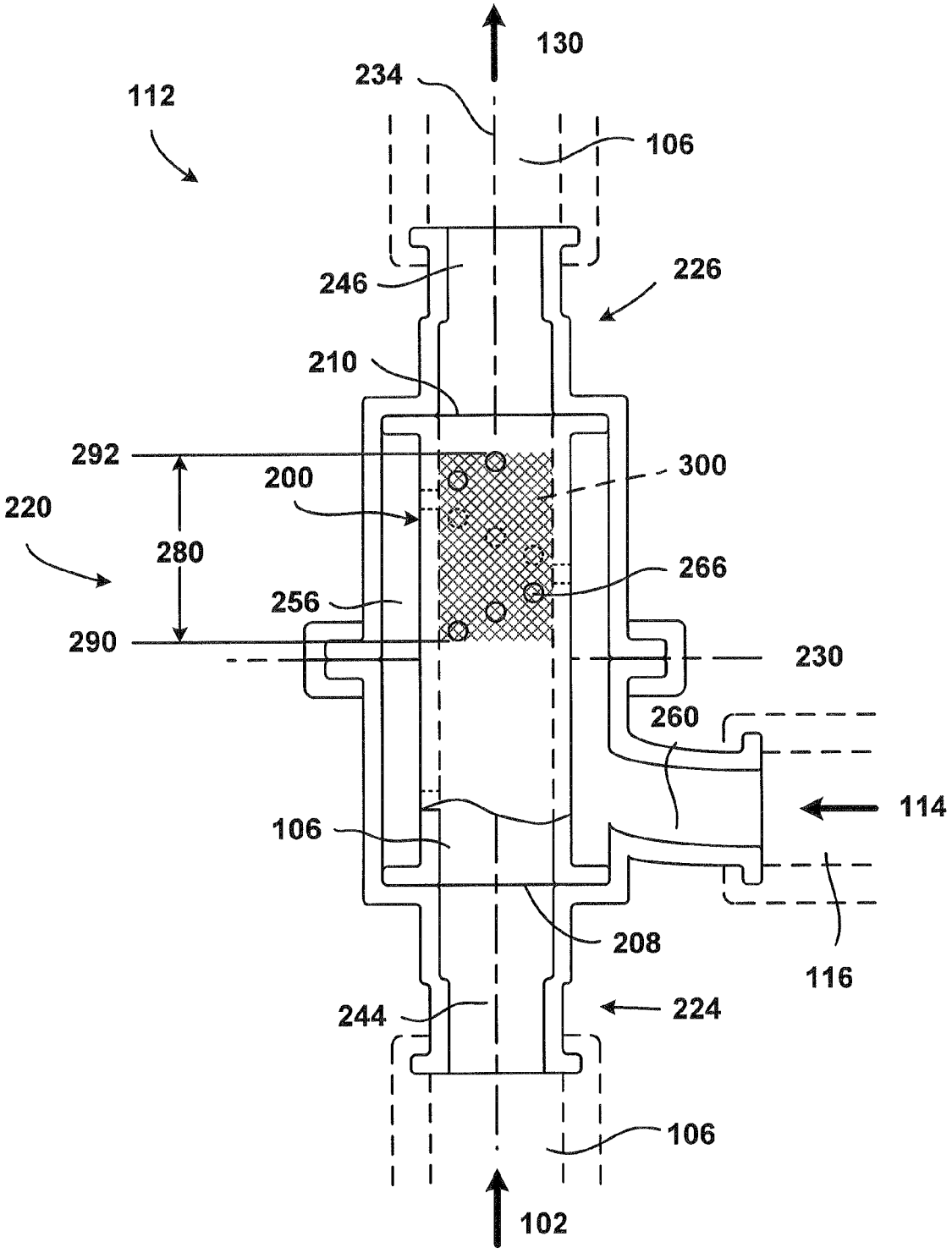
FIG. 11 is a schematic drawing of another embodiment of an exhaust gas recirculation apparatus according to the present disclosure.

Now, in referring to FIG. 11, it has been found the apertures 266 may be particularly arranged along a longitudinal length 280 of the intake passage 106, with the length 280 and cross-sectional area of the intake passage 106 defining an intake passage volume 300 (shown by the cross-hatched area) which corresponds to a particular displacement of the engine 100. As shown in FIG. 10, a length 280 of the intake passage 106 may have a volume 300 in the range of 25% to 50% of a total cylinder displacement of the internal combustion engine 100 (i.e. the volume swept by all the pistons inside the cylinders of the internal combustion engine in a single movement from top dead center to bottom dead center) and all the apertures 266 may be distributed along (within) the length 280, from a beginning 290 of the length 280 to an end 292 of the length 290 (with one aperture at a beginning 290 of the length 280 and another aperture at an end of the length 292). Stated another way, all the apertures 266 are arranged along a length 280 of the intake passage 106 and a volume 300 of the intake passage 106 corresponding to the length 280 of the apertures 266 is in a range of 25% to 50% of a displacement of the engine 100.

Figure 12:
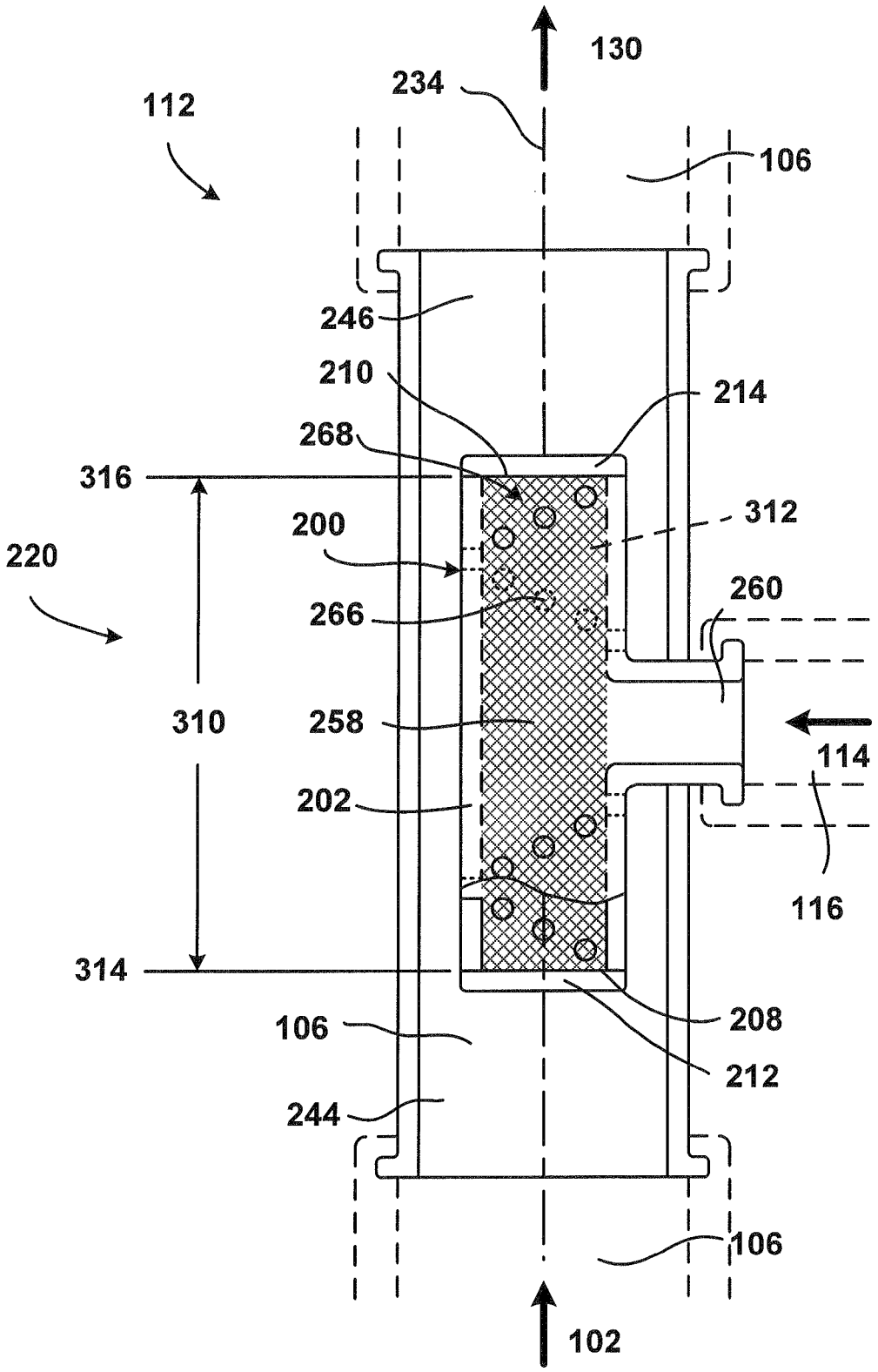
FIG. 12 is a schematic drawing of another embodiment of an exhaust gas recirculation apparatus according to the present disclosure.

Now, in referring to FIG. 12, in contrast to FIG. 3, there is shown a more simplified distributor/mixer apparatus 112 with an outer member 220 having a single piece construction. As shown in FIG. 12, the inlet 208 and outlet 210 of inner member 200 have been closed and sealed with end caps 212 and 214, respectively. As such, intake passage 106 extends around (outside of) circular (cylindrical) side wall structure 202 of inner member 200, in contrast to the embodiment of FIG. 3 wherein intake passage 106 extends through the (inside of) circular (cylindrical) side wall structure 202 of inner member 200. Also in contrast to FIG. 3, FIG. 12 shows a cylindrical exhaust gas chamber 258 formed within inner member 200.

As shown, exhaust gas chamber 258 is surrounded by intake passage 106 along its length and is separated from intake passage 106 by wall structure 202 of inner member 200, with intake passage 106 located to an outer side of side wall structure 202, and exhaust gas chamber 258 located to an inner side of side wall structure 202. As intake passage 106 and exhaust gas chamber 258 of outer member 200 are shown to share a common longitudinal axis 234, intake passage 106 and exhaust gas chamber 258 may be understood to be coaxially arranged, with intake passage 106 having an annular shape and exhaust gas chamber 258 having a cylindrical (non-annular) shape.

Exhaust gas chamber 258 may be configured to receive recirculated exhaust gas 114 through exhaust gas inlet 260 which is in fluid communication with exhaust gas recirculation passage 116. Thereafter, the exhaust gas 114 may flow into chamber 258 and then exit chamber 258 through a plurality of apertures 266 formed in side wall structure 202 of inner member 200 to distribute recirculated exhaust gas 114 into the intake passage 106. Upon passing through apertures 266, the exhaust gas 114 may enter intake passage 106 and mix with air 102 therein to thereafter provide the air/exhaust gas mixture 130. As shown in FIG. 12, exhaust gas inlet 260 may be centered along a length of inner member 200 and exhaust gas chamber 258. Furthermore, exhaust gas inlet 260 may feed exhaust gas 114 into exhaust gas chamber 258 at an orientation perpendicular to a length of chamber 258.

In order to ensure the proper direction of flow for air 102 and exhaust gas 114, recirculation loop 118 may be configured such that normal operating pressures of exhaust gas 114 in recirculation passage 116 and chamber 258 are slightly greater than the normal operating pressures of the air 102 within air intake passage 106. In this manner, the greater pressure of the exhaust gas 114 will ensure a flow of exhaust gas 114 out of chamber 258 through apertures 266 and into air intake passage 106 rather than a flow of air 102 in the wrong direction into chamber 258.

Among other things, apertures 266 are configured and arranged to distribute recirculated exhaust gas 114 into the air intake passage 106. More particularly, apertures 266 may be configured and arranged to dampening the pulsations of exhaust gas 114 from D-EGR cylinder 156 in such a manner that variations in temporal (longitudinal) and radial distribution of exhaust gas 114 into the air intake passage 106 as a result of the pulsations may be increased.

As shown in FIG. 12, apertures 266 may be arranged in a helical pattern 268 along a length 280 (longitudinally in direction of axis 234) of the side wall structure 202 and air intake passage 106. By using the helical pattern 268 shown, apertures 266 are arranged and distributed along a longitudinal length of exhaust gas chamber 258 of inner member 200 and axis 234, as well as around the perimeter (circumference) of inner member 200 and axis 234. Furthermore, apertures 266 are arranged to expel exhaust 114 gas radially towards intake passage 106 and away from longitudinal axis 234 and chamber 258 in an effort to maximize interaction between the exhaust gas 114 and air 102. In the foregoing manner, both the temporal and radial mixing of exhaust gas 114 may be respectively increased in the air 102 within intake passage 106.

In addition to the foregoing, it should be understood that dampening the pulsations of exhaust gas 114 from D-EGR cylinder 156 in such a manner that variations in temporal (longitudinal) and radial distribution of exhaust gas 114 into the air intake passage 106 are decreased may be accomplished with other geometric patterns of apertures 266 other than the helical pattern shown in FIG. 12, such as by any of the geometric patterns disclosed herein (see FIGS. 4-10).

In continuing with FIG. 12, it has been found the apertures 266 may be particularly arranged along a longitudinal length 310 of the exhaust gas chamber 258, with the length 310 and cross-sectional area of the exhaust gas chamber 258 defining an exhaust chamber volume 312 (shown by the cross-hatched area, not including inlet 260) which corresponds to a particular displacement of the engine 100. As shown in FIG. 12, a length 310 of the exhaust gas chamber 258 may have a volume 312 in the range of 25% to 50% of a total cylinder displacement of the internal combustion engine 100 (i.e. the volume swept by all the pistons inside the cylinders of the internal combustion engine in a single movement from top dead center to bottom dead center) and all the apertures 266 may be distributed along (within) the length 310, from a beginning 314 of the length 310 to an end 316 of the length 310. Furthermore, as shown, apertures 266 are preferably configured and located upstream of inlet 260 (towards air inlet passage 244) and/or downstream of inlet 260 (towards outlet passage 246) such that exhaust gas 114 must either flow upstream or downstream, respectively in exhaust chamber 258 before exiting chamber 258 and may not exit the exhaust gas chamber 258 by flowing parallel with inlet 260.

While a preferred embodiment of the present invention(s) has been described, it should be understood that various changes, adaptations and modifications can be made therein without departing from the spirit of the invention(s) and the scope of the appended claims. The scope of the invention(s) should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

What is claimed:

1. A system to manage exhaust gas expelled from cylinders of an internal combustion engine, the system comprising:

an intake system including an exhaust gas recirculation apparatus to distribute recirculated exhaust gas in an air stream to for an internal combustion engine statically without any moving structure;

the apparatus having a first inlet to receive ambient air, a second inlet to receive recirculated exhaust gas, and an outlet to provide a mixture of the air and the recirculated exhaust gas, the air-exhaust gas mixture to be provided to the internal combustion engine through an intake manifold;

an intake passage between the first inlet and the outlet;

an exhaust gas chamber to receive the recirculated exhaust gas from the second inlet, wherein the exhaust gas chamber has a longitudinal length extending along a longitudinal length of the intake passage;

the exhaust gas chamber separated from the intake passage by a wall structure of the apparatus, wherein the exhaust gas chamber is in fluid communication with the intake passage by a plurality of apertures arranged on the wall structure;

wherein the plurality of apertures are configured to distribute the recirculated exhaust gas radially into the intake passage from the exhaust gas chamber along the longitudinal length of the intake passage; and wherein the plurality of apertures are arranged in a pattern which compensates for a drop in recirculated exhaust gas pressure along the longitudinal length of the exhaust gas chamber.

2. The system of claim 1 wherein:

the exhaust gas chamber is configured to receive exhaust gas from a dedicated exhaust gas recirculation cylinder of the internal combustion engine, wherein 90%-100% by volume of exhaust gas expelled from the dedicated exhaust gas recirculation cylinder is recirculated to the exhaust gas chamber.

3. The system of claim 1 wherein:

the intake passage is located on an inner side of the wall structure; and the exhaust gas chamber is located on an outer side of the wall structure.

4. The system of claim 1 wherein:

the exhaust gas chamber is located on an inner side of the wall structure; and the intake passage is located on an outer side of the wall structure.

5. The system of claim 1 wherein:

the exhaust gas chamber surrounds the intake passage along the longitudinal length of the intake passage.

6. The system of claim 1 wherein:

the intake passage surrounds the exhaust chamber along the longitudinal length of the exhaust chamber.

7. The system of claim 1 wherein:

the exhaust gas chamber is annular around the longitudinal length of the intake passage.

8. The system of claim 1 wherein:

the intake passage is annular around the longitudinal length of the exhaust chamber.

9. The system of claim 1 wherein:

the exhaust gas chamber and the intake passage are coaxially arranged.

10. The system of claim 1 wherein:

the wall structure is provided by a tubular member.

11. The system of claim 10 wherein:

the tubular member is located within a receptacle of a surrounding member.

12. The system of claim 10 wherein:

the tubular member is removable from the surrounding member.

13. The system of claim 1 wherein:

the apertures are arranged in a helical pattern along the longitudinal length of the intake passage.

14. The system of claim 1 wherein:

the apertures are arranged in a row along the longitudinal length of the intake passage.

15. The system of claim 1 wherein:

the apertures are arranged around at least a portion of a perimeter of the intake passage.

16. The system of claim 15 wherein:

the apertures are arranged in a helical pattern around at least a portion of the perimeter of the intake passage.

17. The system of claim 15 wherein:

the apertures are arranged in a ring around at least a portion of the perimeter of the intake passage.

18. The system of claim 1 wherein:

the apertures are arranged around at least a portion of a perimeter of an exhaust chamber.

19. The system of claim 18 wherein:

the apertures are arranged in a helical pattern around at least a portion of the perimeter of the exhaust chamber.

20. The system of claim 18 wherein:

the apertures are arranged in a ring around at least a portion of the perimeter of the exhaust chamber.

21. The system of claim 1 wherein:

the apertures are arranged along a length of the intake passage, with a first aperture at a beginning of the length and a last aperture at an end of the length, and the intake passage has a volume corresponding to the length of the intake passage, the volume in a range of 25% to 50% of a displacement of the engine.

22. The system of claim 1 wherein:

the exhaust gas chamber has volume in the range of 25% to 50% of a displacement of the internal combustion engine.

23. A method to distribute recirculated exhaust gas in an air stream to be introduced to an internal combustion engine, the method comprising:

providing an exhaust gas recirculation apparatus of an intake system, the apparatus to distribute recirculated exhaust gas in an air stream for an internal combustion engine statically without any moving structure, the apparatus having a first inlet to receive ambient air, a second inlet to receive recirculated exhaust gas, and an outlet to provide a mixture of the air and the recirculated exhaust gas, the air-exhaust gas mixture to be provided to the internal combustion engine through an intake manifold, an intake passage between the first inlet and the outlet, an exhaust gas chamber to receive the recirculated exhaust gas from the second inlet, wherein the exhaust gas chamber has a longitudinal length extending along a longitudinal length of the intake passage, the exhaust gas chamber separated from the intake passage by a wall structure of the apparatus, wherein the exhaust gas chamber is in fluid communication with the intake passage by a plurality of apertures arranged on the wall structure, wherein the plurality of apertures are configured to distribute the recirculated exhaust gas radially into the intake passage from the exhaust gas chamber along the longitudinal length of the intake passage, wherein the plurality of apertures are arranged in a pattern which compensates for a drop in recirculated exhaust gas pressure along the longitudinal length of the exhaust gas chamber, introducing ambient air into the intake passage from the first inlet;

distributing recirculated exhaust gas radially into the intake passage from the exhaust gas chamber through the plurality of apertures along the longitudinal length of the intake passage to provide a mixture of air and recirculated exhaust gas; and arranging the plurality of apertures in a pattern which compensates for a drop in recirculated exhaust gas pressure along the longitudinal length of the exhaust gas chamber.

24. The method of claim 23 wherein:

distributing recirculated exhaust gas into the intake passage through the plurality of apertures to provide a mixture of air and recirculated exhaust gas further comprises distributing recirculated exhaust gas into the intake passage through the plurality of apertures along a longitudinal length of the intake passage to provide a mixture of air and recirculated exhaust gas.

25. The method of claim 23 wherein:

distributing recirculated exhaust gas into the intake passage through the plurality of apertures to provide a mixture of air and recirculated exhaust gas further comprises distributing recirculated exhaust gas into the intake passage through the plurality of apertures from an exhaust gas chamber around a perimeter of the intake passage or with within the intake passage.

* * * * *